United States Patent [19]

Springston

[11] Patent Number: 4,938,400

[45] Date of Patent: Jul. 3, 1990

[54] COMBINATION PACK AND SEAT

[76] Inventor: Ted B. Springston, 79 Prairie Ridge Rd., Highlands Ranch, Colo. 80126

[21] Appl. No.: 396,134

[22] Filed: Aug. 21, 1989

[51] Int. Cl.[5] ..... A45F 4/02

[52] U.S. Cl. ..... 224/155; 224/153; 224/161; 297/118; 297/174

[58] Field of Search ..... 224/155, 153, 160, 161; 297/118, 174

[56] References Cited

U.S. PATENT DOCUMENTS

| | | | |
|---|---|---|---|
| 3,222,104 | 12/1965 | Remington et al. | 297/174 |
| 3,713,568 | 1/1973 | Sloan | 224/161 |
| 3,989,173 | 11/1976 | Gebhard | 224/161 |
| 4,157,837 | 6/1979 | Kao | 224/161 |
| 4,300,707 | 11/1981 | Kjaer . | |
| 4,530,451 | 7/1985 | Hamilton . | |
| 4,620,711 | 11/1986 | Dick . | |
| 4,676,548 | 7/1987 | Bradbury . | |
| 4,720,029 | 1/1988 | Varanakis . | |
| 4,747,526 | 5/1988 | Launes | 224/155 |
| 4,762,256 | 8/1988 | Whitaker | 224/155 |
| 4,844,537 | 7/1989 | Reed | 297/174 |

*Primary Examiner*—Linda J. Sholl

*Attorney, Agent, or Firm*—Jerry T. Kearns

[57] ABSTRACT

A combination pack and seat is convertible for use as a table engaging child seat, and back pack type child carrier, and a free standing child seat. The combination pack and seat includes a pair of spaced side frame members extending in parallel relation and each connected by a radiused bend portion with an obliquely extending ground support foot. An upper end of each of the side frame members are connected by an arcuate curved portion with a top frame member. The top frame members extend in spaced parallel relation and are connected by a transverse end bar to form a rectangular channel. A child carrying pouch formed from a flexible material is suspended from the top frame members and the transverse end bar, within the rectangular channel. A pair of pivotal struts are mounted by pivotal detent mechanisms adjacent the arcuate curved portion on each of the side frame members. The pivotal struts each terminate in a non-slip tip adapted for ground engagement, and include a transversely extending abutment member adapted for engagement with a bottom surface of a table top. A pair of adjustable padded shoulder straps are provided for carrying the frame in a back pack fashion. Telescopic extension members are mounted for selective extension and retraction in the top frame members and each terminate in a non-slip tip. A table top may be clamped between the extension members and the pivotal strut abutment members.

16 Claims, 3 Drawing Sheets

COMBINATION PACK AND SEAT

BACKGROUND OF THE INVENTION

1. Field of the Invention

The present invention relates to combination packs and seats, and more particularly pertains to a combination back pack type child carrier and child seat. Many individuals with infants and small children must carry a small child on various family outings. At a family meal or picnic in an area where no high chairs are available, a family member must hold and feed the infant or small child while the family eats. The small child frequentlY spills food on the adult who is holding the child and otherwise inconveniences the adult. While various forms of high chairs for infants and small children have been heretofore proposed, these devices are relatively bulky and difficult to transport. Likewise, many different forms of back pack type child carriers are known in the prior art. The present invention overcomes the above mentioned problems by providing a combination back pack type child carrier which is selectively convertible to a free standing or a table engaging child seat.

2. Description of the Prior Art

Various types of combination packs and seats are known in the prior art. A typical example of such a combination pack and seat is to be found in U.S. Pat. No. 4,300,707, which issued to P. Kjaer on Nov. 17, 1981. This patent discloses a rucksack frame pivotal to a first functional position for use as a chair with a back rest and to a second position for use as a back pack type carrier. U.S. Pat. No. 4,530,451, which issued to J. Hamilton on July 23, 1985, discloses a combination back pack and beach chair which includes two hinged sections which articulate over an arc of about 45 degrees. A seat pad is hinged to the free end of one section and a storage bag detachably engages the other section. U.S. Pat. No. 4,620,711, which issued to T. Dick on Nov. 4, 1986, discloses a multi-function child carrier which includes a seat mounting frame which supports a child seat. The device is convertible to a first orientation for use as a child car seat and to a second orientation for use as a stroller. U.S. Pat. No. 4,676,548, which issued to P. Bradbury on June 30, 1987, discloses a combination knapsack and frame which is convertible to a folding chair. The frame includes a generally rectangular-shaped back section fixedly connected to a back pack storage bag and a generally rectangular seat section that is indirectly connected to the back and pivotally connected to the back section. U.S. Pat. No. 4,720,029, which issued to J. Varanakis on Jan. 19, 1988, discloses a small folding chair having a pair of shoulder straps connected to a back section. The chair frame is usable for the securement of various articles and storage bags.

While the above mentioned devices are directed to combination packs and seats, none of these devices disclose a combination back pack type child carrier and child seat which is convertible to a first orientation for use as a free standing child seat, to a second orientation for use as a table engaging high chair type child seat, and to a third orientation for use as a back pack type child carrier. Inasmuch as the art is relatively crowded with respect to these various types of combination packs and seats, it can be appreciated that there is a continuing need for and interest in improvements to such combination packs and seats, and in this respect, the present invention addresses this need and interest.

SUMMARY OF THE INVENTION

In view of the foregoing disadvantages inherent in the known types of combination packs and seats now present in the prior art, the present invention provides an improved combination pack and seat. As such, the general purpose of the present invention, which will be described subsequently in greater detail, is to provide a new and improved combination pack and seat which has all the advantages of the prior art combination packs and seats and none of the disadvantages.

To attain this, a representative embodiment of the concepts of the present invention is illustrated in the drawings and makes use of a combination pack and seat which is convertible for use as a table engaging child seat, a back pack type child carrier, and a free standing child seat. The combination pack and seat includes a pair of spaced side frame members extending in parallel relation and each connected by a radiused bend portion with an obliquely extending ground support foot. An upper end of each of the side frame members are connected by an arcuate curved portion with a top frame member. The top frame members extend in spaced parallel relation and are connected by a transverse end bar to form a rectangular channel. A child carrying pouch formed from a flexible material is suspended from the top frame members and the transverse end bar, within the rectangular channel. A pair of pivotal struts are mounted by pivotal detent mechanisms adjacent the arcuate curved portion on each of the side frame members. The pivotal struts each terminate in a non-slip tip adapted for ground engagement, and include a transversely extending abutment member adapted for engagement with a bottom surface of a table top. A pair of adjustable padded shoulder straps are provided for carrying the frame in a back pack fashion. Telescopic extension members are mounted for selective extension and retraction in the top frame members and each terminate in a non-slip tip. By extending the extension members and moving the pivotal struts to a generally parallel orientation, a table top may be clamped between the extension members and the pivotal strut abutment members.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved combination pack and seat which has all the advantages of the prior art combination packs and seats and none of the disadvantages.

It is another object of the present invention to provide a new and improved combination pack and seat which may be easily and efficiently manufactured and marketed.

It is a further object of the present invention to provide a new and improved combination pack and seat which is of a durable and reliable construction.

An even further object of the present invention is to provide a new and improved combination pack and seat which is susceptible of a low cost of manufacture with regard to both materials and labor, and which accordingly is then susceptible of low prices of sale to the consuming public, thereby making such combination packs and seats economically available to the buying public.

Still yet another object of the present invention is to provide a new and improved combination pack and seat which provides in the apparatuses and methods of the prior art some of the advantages thereof, while simultaneously overcoming some of the disadvantages normally associated therewith.

Still another object of the present invention is to provide a new and improved combination pack and seat to enable individuals to conveniently transport and seat small children and infants utilizing a single convertible device.

Yet another object of the present invention is to provide a new and improved combination pack and seat which is convertible between a back pack type child carrier and a table engaging high chair type child seat.

Even still another object of the present invention is to provide a new and improved combination pack and seat which is convertible between a first configuration forming a back pack type child carrier, a second configuration forming a free standing child seat, and a third configuration forming a high chair type table engaging child seat.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
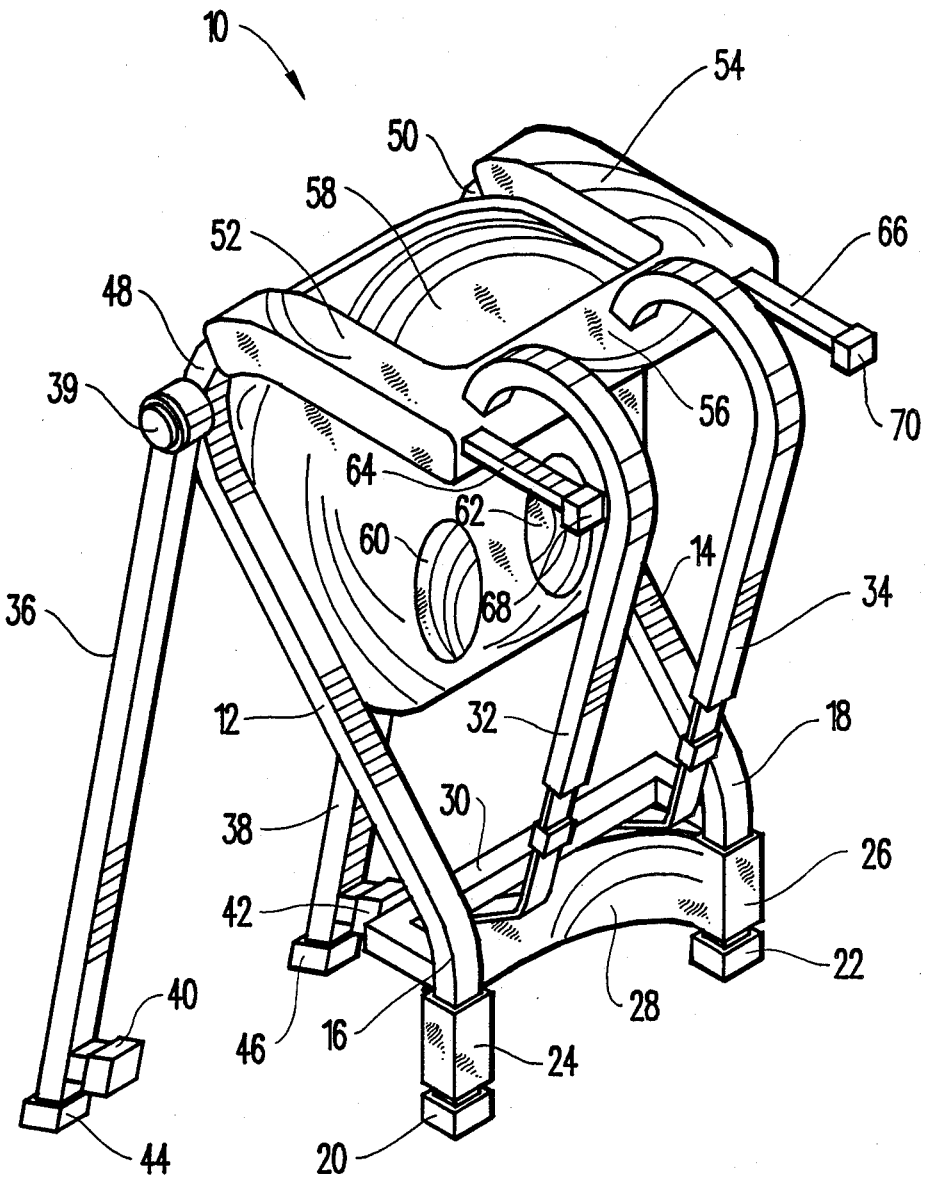
FIG. 1 is a perspective view of the combination pack and seat according to the present invention.

With reference now to the drawings, and in particular to FIG. 1 thereof, a new and improved combination pack and seat embodying the principles and concepts of the present invention and generally designated by the reference numeral 10 will be described.

More specifically, it will be noted that the first embodiment 10 of the invention includes a pair of spaced side frame members 12 and 14 which extend in parallel spaced relation. The side frame members 12 and 14 are each connected by a radiused bend portion 16, 18 with an obliquely extending ground support foot 20, 22. The ground support feet each terminate in a resilient non-slip tip and are adapted for engagement with the surface of the ground. An offset support brace 30 has a generally rectangular channel configuration and has opposite ends secured to the ground support feet, adjacent the radiused bend portions 16 and 18. A back support strap 28, preferably formed from a flexible fabric material such as nylon, extends between the ground support feet and has opposite ends secured by stitched fabric loops 24 and 26. An upper end of each of the side frame members 12 and 14 is connected by an arcuate curved portion 48, 50, with a top frame member 52, 54. The frame members 52 and 54 extend in spaced parallel relation, generally transverse to the ground support feet 20 and 22. The free ends of the top frame members 52 and 54 terminate at a position in generally vertical alignment with the ground support feet 20 and 22. A transverse end bar 56 is secured between the free end portions of the top frame members 52 and 54. The top frame members 52, 54 and the transverse end bar 56 are covered with a resilient padding material and form a rectangular channel opening in which a child carrying pouch 58 is suspended. The child carrying pouch 58 is preferably formed from a flexible fabric material and includes a pair of spaced leg receiving apertures 60 and 62. An extension member 64, 66 is telescopically received in a free end of each of the top frame members 52 and 54. The extension members 64 and 66 are mounted for selective linear extension and retraction and extend in parallel relation. The extension members 64 and 66 each terminate in a non-slip tip 68, 70 formed from a resilient material, such as rubber. A pair of padded shoulder straps 32, 34 extend between the top end bar 56 and the support brace 30. The shoulder straps 32 and 34 may include conventional adjustment mechanisms for adjusting the length of the straps 32 and 34. A pair of pivotal struts 36 and 38 each have an upper end mounted by a pivot mechanism 39 adjacent the arcuate curved portion 48, 50 of one of the side frame members 12 and 14. It should be noted that while only one of the pivot mechanisms 39 is shown, the opposite pivotal strut 38 is mounted in a symmetrical fashion. Each of the pivotal struts 36 and 38 terminate at a lower end in a non-slip tip 44, 46. A transversely extending abutment member 40, 42 is secured adjacent a lower end of each of the pivotal struts 36, 38 and terminates in a non-slip tip adapted for engagement with the lower surface of a table top. In the illustrated configuration, the combination pack and seat may be utilized as a free standing child seat, with the resilient non-slip tip 20, 22, 44 and 46 in abutment with a horizontal ground surface. It should be noted that the pivot mechanisms 39 are of a lockable detent type which allows the securement of the pivotal struts 36 and 38 in a variety of selected angular orientations.

Figure 2:
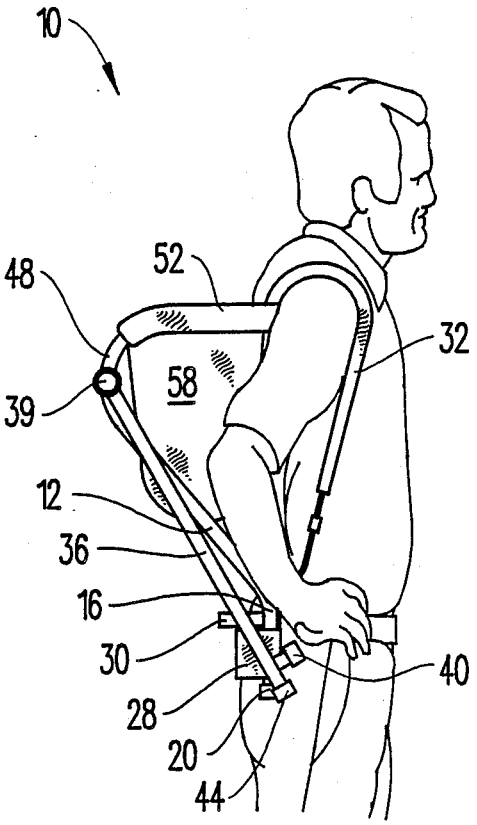
FIG. 2 is a side view of the combination pack and seat of the present invention in a back pack child carrier configuration, as carried by an individual.

FIG. 2 illustrates the combined pack and seat 10 converted to a back pack type child carrier. The pivotal struts, one of which 36 is shown, are pivoted and locked in the illustrated collapsed orientation. A child may then be inserted into the pouch 58 and carried in the manner of a conventional back pack type child carrier. The back support strap 28 engages the lower back portion of the carrying individual and provides for added support and comfort.

Figure 3:
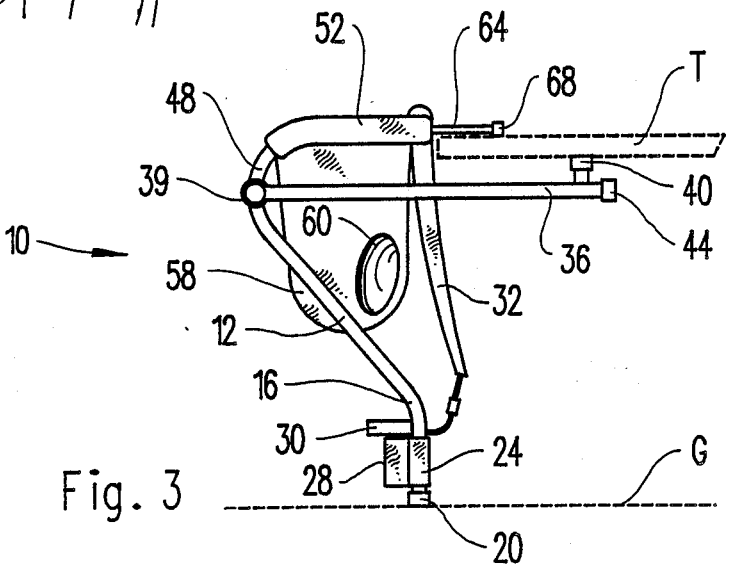
FIG. 3 is a side view of the combination pack and seat in a table engaging, high chair configuration.

FIG. 3 illustrates the combined pack and seat 10, converted to a table engaging, high chair type child seat. The pivotal struts, one of which is shown at 36, at each pivoted and locked to a generally horizontal position in which the abutment members, one of which is shown at 40, engages the bottom surface of a table top T. The ground engaging feet, one of which is shown at 20, of the side frame members, one of which is illustrated at 16, engage the surface of the ground G. Both of the extension members, one of which is illustrated at 64, are moved to an extended position, in which the non-slip tips, one of which is illustrated at 68, engage the top surface of the table top T. A child may then be inserted into the pouch 58, and may consume food placed on the upper surface of the table top T, in the manner of a conventional high chair. This allows adult family members to be free to consume their own meal in relative peace.

Figure 4:
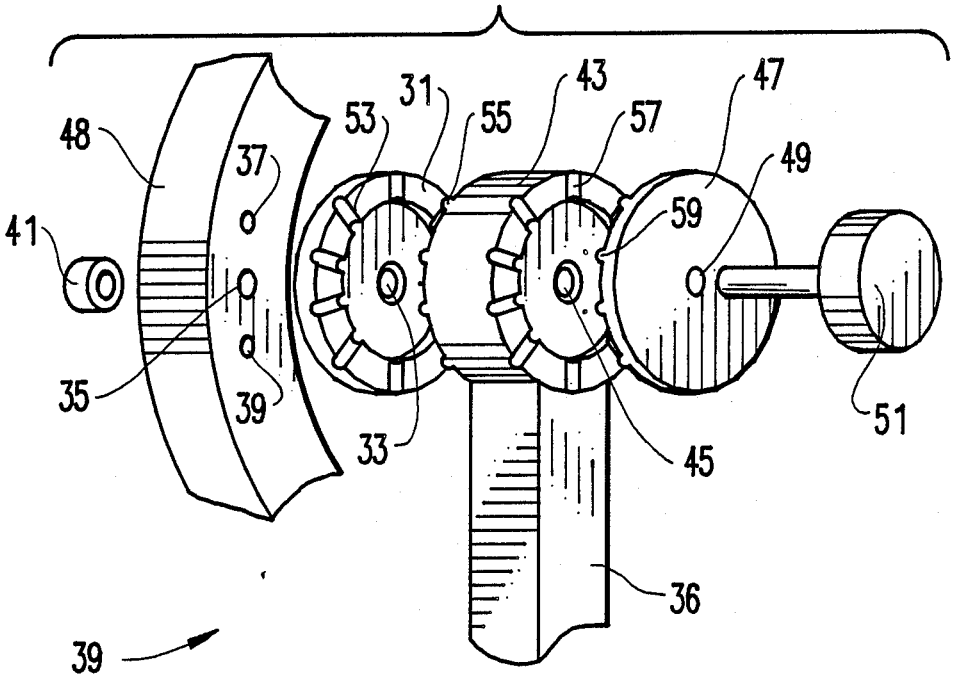
FIG. 4 is an exploded perspective view illustrating a detent pivotal adjustment mechanism utilized in the combination pack and seat of the present invention.

FIG. 4 is an exploded detail view illustrating an example form of pivot mechanism 39 which may be utilized to secure the upper ends of each of the pivotal struts, for example 36. The arcuate curved portion, for example 48, of each of the side frame members is secured to a stationary locking disk 31. A pair of circular apertures 37 and 39 may be provided on the arcuate curved portion 48 for engagement with complementary formed pins (not shown) formed on the back side of the disk 31. The disk 31 is thus secured in a fixed position on the curved portion 48, with a central aperture 33 in alignment with a circular bore 35 formed through the curved portion 48. The upper end of the pivotal strut 36 is provided with a generally cylindrical boss 43. A circular array of radially extending projections 55 is provided on one face of the boss 43 and is adapted for cooperation with a circular array 53 of complementary formed radially extending recesses formed on an outer face of the disk 31. A similar array of radially extending recesses 57 is formed on an outer face of the boss 43 and is adapted for engagement with a complementarY formed array 59 of projections formed on an inner face of a cover plate 47. Circular apertures 45 and 49 are formed respectively through the boss 43 and cover plate 47 and adapted for coaxial alignment with the apertures 33 and 35. A locking screw 51 extends through the apertures 49, 45, 33 and 35 for engagement with a threaded nut member 41. The threaded nut member 41 may be embedded within the bore 35, or secured to the opposite side of the curved portion 48. As may now be understood, the clamping screw 51 may be loosened, allowing the pivotal strut 36 to be moved to a selected angularly adjusted position. At this point, the clamping screw 51 is then tightened to secure the cooperating recesses and projections in a locked position. While the illustrated form of pivot mechanism 39 may be utilized, it should be noted that a variety of other pivotal detent mechanism may be employed without departing from the scope of the present invention. For example, a plurality of arcuately arrayed apertures may be utilized, in conjunction with a selectively positional locking pin. Similarly, a spring bias ball detent type mechanism may also be provided. In any case, the salient aspects of the pivot mechanism 39 is that it affords selective angular adjustment of the strut 36 and allows the strut 36 to be securely locked in any selected orientation.

As may now be understood, the present invention provides a combination pack and seat which is usable as a back pack type child carrier, or converted for use as a free standing type child seat, or a table engaging high chair type seat.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the U.S. is as follows:

1. A combination pack and seat, comprising:

a pair of spaced side frame members extending in parallel relation;

each of said side frame members connected by a radiused bend portion with an obliquely extending ground support foot;

a non-slip tip formed from a resilient material on each of said ground support feet;

an offset support brace extending between said ground support feet, opposite ends of said support brace secured adjacent said radiused bend portions;

a back support strap extending between said ground support feet, opposite ends of said ground support straps secured to said feet between said support brace in said non-slip tip;

an upper end of each of said side frame members connected by an arcuate curved portion with a top frame member, said top frame members extending in spaced parallel relation;

a transverse end bar connecting free end portions of said top frame members;

a resilient padding material covering said top frame members and said top end bars;

a child carrying pouch formed from a flexible material suspended from said top frame members and said top end bar, said pouch having an open upper end disposed in a rectangular channel formed by said top frame members and said top end bars;

a pair of feet receiving apertures in said pouch;

an extension member telescopically received in a free end of each of said top frame members, said extension members mounted for selective linear extension and retraction and extending in parallel relation;

a non-slip tip formed from a resilient material on a free end of each of said extension members;

a pair of padded adjustable shoulder straps extending between said top end bar and said support brace;

a pair of pivotal struts, each having an upper end mounted by a pivot mechanism adjacent said arcuate curved portion of one of said frame members;

each of said pivotal struts terminating at a lower end in a non-slip tip formed from a resilient material;

a transversely extending abutment member adjacent said lower end on each of said pivotal struts, each of said abutment members terminating in a non-slip tip formed from a resilient material; and each of said pivot mechanisms including a circular array of cooperating detents for locking said pivotal struts in a selected position, whereby said pivotal struts may be pivoted to a first position to carry a child in said pouch in a back pack fashion, and to a second position to form a free standing child seat, and to third position to engage a table top between said pivotal struts and said extension members to form a table engaging child seat.

2. A combination pack and seat, comprising:

a frame;

carrying means on a top portion of said frame for carrying a child;

shoulder strap means on said frame for carrying said frame in a back pack fashion;

a pair of spaced pivotal struts on said frame, said pivotal struts movable to a first position to form a back pack child carrier and to a second position to form a table top engaging child seat;

each of said pivotal struts terminating at a lower end in a non-slip tip adapted for ground engagement; and a transverse abutment member adjacent said lower end of each of said pivotal struts, said abutment members each terminating in a non-slip tip adapted for engagement with a bottom surface of a table top.

3. The combination pack and seat of claim 2, wherein each of said pivotal struts are movable to a third position to form a free standing child seat.

4. The combination pack and seat of claim 2, wherein said carrying means includes a pouch formed from a flexible material and having a pair of leg receiving apertures.

5. The combination pack and seat of claim 2, further comprising telescopic extension means on said frame for engagement with a table top.

6. The combination pack and seat of claim 2, wherein said frame includes a pair of frame members each terminating in a non-slip tip adapted for ground engagement.

7. The combination pack and seat of claim 2, wherein said carrying means includes a pair of spaced top frame members connected by a transverse top end bar.

8. The combination pack and seat of claim 7, further comprising a pouch formed from a flexible material suspended from said top frame members and said top end bar.

9. The combination pack and seat of claim 7, further comprising a pair of extension members telescopically received in a free end of each of said top frame members.

10. A combination pack and seat, comprising:

a frame;

carrying means on a top portion of said frame for carrying a child;

shoulder strap means on said frame for carrying said frame in a back pack fashion;

a pair of spaced pivotal struts on said frame, said pivotal struts selectively movable to a first position to form a back pack child carrier and to a second position to form a table top engaging child seat;

a transverse abutment member adjacent a lower end of each of said pivotal struts, said abutment members each terminating in a non-slip tip adapted for engagement with a bottom surface of a table top; and telescopic extension means on said top portion of said frame for selective engagement with a table top, whereby a table top may be selectively disposed between said telescopic extension means and said transverse abutment members.

11. The combination pack and seat of claim 10, wherein each of said pivotal struts are movable to a third position to form a free standing child seat.

12. The combination pack and seat of claim 10, wherein said carrying means includes a pouch formed from a flexible material and having a pair of leg receiving apertures.

13. The combination pack and seat of claim 10, wherein said frame includes a pair of frame members each terminating in a non-slip tip adapted for ground engagement.

14. The combination pack and seat of claim 10, wherein said carrying means includes a pair of spaced top frame members connected by a transverse top end bar.

15. The combination pack and seat of claim 14, further comprising a pouch formed from a flexible material suspended from said top frame members and said top end bar.

16. The combination pack and seat of claim 14, wherein said telescopic extension means comprises a pair of extension members telescopically received in a free end of each of said top frame members.

* * * * *